US007487955B1

(12) United States Patent
Buercklin

(10) Patent No.: US 7,487,955 B1
(45) Date of Patent: Feb. 10, 2009

(54) PASSIVE DESUPERHEATER

(75) Inventor: Keith Buercklin, Robinson, IL (US)

(73) Assignee: Marathon Petroleum LLC, Findlay, OH (US)

( * ) Notice: Subject to any disclaimer, the term of this patent is extended or adjusted under 35 U.S.C. 154(b) by 157 days.

(21) Appl. No.: 11/293,403

(22) Filed: Dec. 2, 2005

(51) Int. Cl.
*B01F 3/04* (2006.01)

(52) U.S. Cl. ..... 261/128; 251/152; 251/122.1; 251/DIG. 13

(58) Field of Classification Search ..... 261/122.1, 261/124, 128, 129, 130, 152, 157, DIG. 10, 261/DIG. 13
See application file for complete search history.

(56) References Cited

U.S. PATENT DOCUMENTS 1,867,143 A * 7/1932 Fohl ..... 159/1.1
3,063,681 A * 11/1962 Duguid ..... 165/302
3,279,441 A * 10/1966 Lippert et al. ..... 122/459
3,400,049 A * 9/1968 Wolfe ..... 376/310
3,545,411 A * 12/1970 Vollradt ..... 122/31.1
4,554,799 A 11/1985 Pallanch
4,684,759 A 8/1987 Lam
5,097,677 A 3/1992 Holtzapple
5,435,436 A 7/1995 Manley et al.
5,647,961 A 7/1997 Lofland
5,758,514 A 6/1998 Genung et al.
5,837,130 A 11/1998 Crossland
6,422,035 B1 7/2002 Phillippe
6,446,446 B1 9/2002 Cowans
6,467,303 B2 10/2002 Ross
7,174,715 B2 * 2/2007 Armitage et al. ..... 60/646

* cited by examiner

*Primary Examiner*—Scott Bushey
(74) *Attorney, Agent, or Firm*—Emch, Schaffer, Schaub & Porcello Co. L.P.A.

(57) ABSTRACT

This is a process and apparatus for using a passive desuperheater for passively desuperheating a superheated gas stream before the stream is transmitted to a heat exchanger. A spent gas stream of a liquid condensate is accumulated in the passive desuperheater. An incoming superheated gas stream comes into the passive desuperheater below the liquid level of the liquid condensate in the passive desuperheater for maximum direct contact heat transfer between the incoming steam and the liquid condensate. An outgoing stream of saturated gas exits the desuperheater above the level of the condensate.

16 Claims, 5 Drawing Sheets

PASSIVE DESUPERHEATER

TECHNICAL FIELD

This invention relates to the use of superheated steam systems for energy input to process exchangers. The passive desuperheater incorporates the desuperheating operation within the exchanger condensate drum by direct contact between incoming superheated steam and the subcooled condensate draining from the exchanger.

BACKGROUND ART

Utility steam is typically available at superheated conditions for heat transfer applications. Superheated steam is less efficient for heat transfer than saturated steam. Superheated steam requires more exchanger surface area than an appropriate level of saturated steam to achieve the same energy input.

A refinery typically operates several levels of utility steam headers. The high pressure steam level is nominally 600 psig and is superheated to ~700° F. These conditions are too severe for direct application as reboiler heat source for several distillation tower applications in the refinery. For instance, the steam is too hot for use in debutanizer reboiler service. The high temperature steam can be cooled by injecting water. However, traditional desuperheaters are complex, expensive, and suffer from poor reliability.

Traditionally, utility steam is de-superheated by the controlled injection of condensate to reduce superheat prior to use in heat exchangers. These injection type desuperheaters require a high pressure condensate source (typically requiring a new pump), an in-line injection nozzle and control valve, and are prone to reliability problems in field service.

SUMMARY OF THE INVENTION

The passive desuperheater of this invention revises the traditional configuration of typical equipment used in steam driven exchangers to perform the desuperheating service without external condensate injection. The passive desuperheater incorporates the desuperheating operation within the exchanger condensate drum by direct contact between incoming superheated steam and the subcooled condensate draining from the exchanger. This system eliminates the need for a separate condensate source and pump, the condensate injection nozzle, and the desuperheating control station.

Using superheated steam for process heat transfer is relatively space inefficient, since exchanger area required for desuperheating the steam transfers only a small fraction of the energy to the receiving stream. The portion of the exchanger dedicated to desuperheating often occupies a relatively large fraction of the overall high-pressure heat exchanger (i.e., desuperheater and condenser) area. This inefficiency results because the desuperheating operation has a low internal heat transfer coefficient due to the heat transfer mechanism during the normal operation of such a system. In comparison, the condenser portion of such an exchanger has a relatively high internal heat transfer coefficient. When the entire high-pressure heat exchanger functions as a condenser, the exchanger can be made smaller to achieve the same heat transfer specification.

The passive desuperheater of this invention introduces superheated steam below the associated condense pot liquid level. Intimate contact between in the incoming steam and the condensate is ensured in this way.

DETAILED DESCRIPTION OF THE INVENTION

Figure 1:
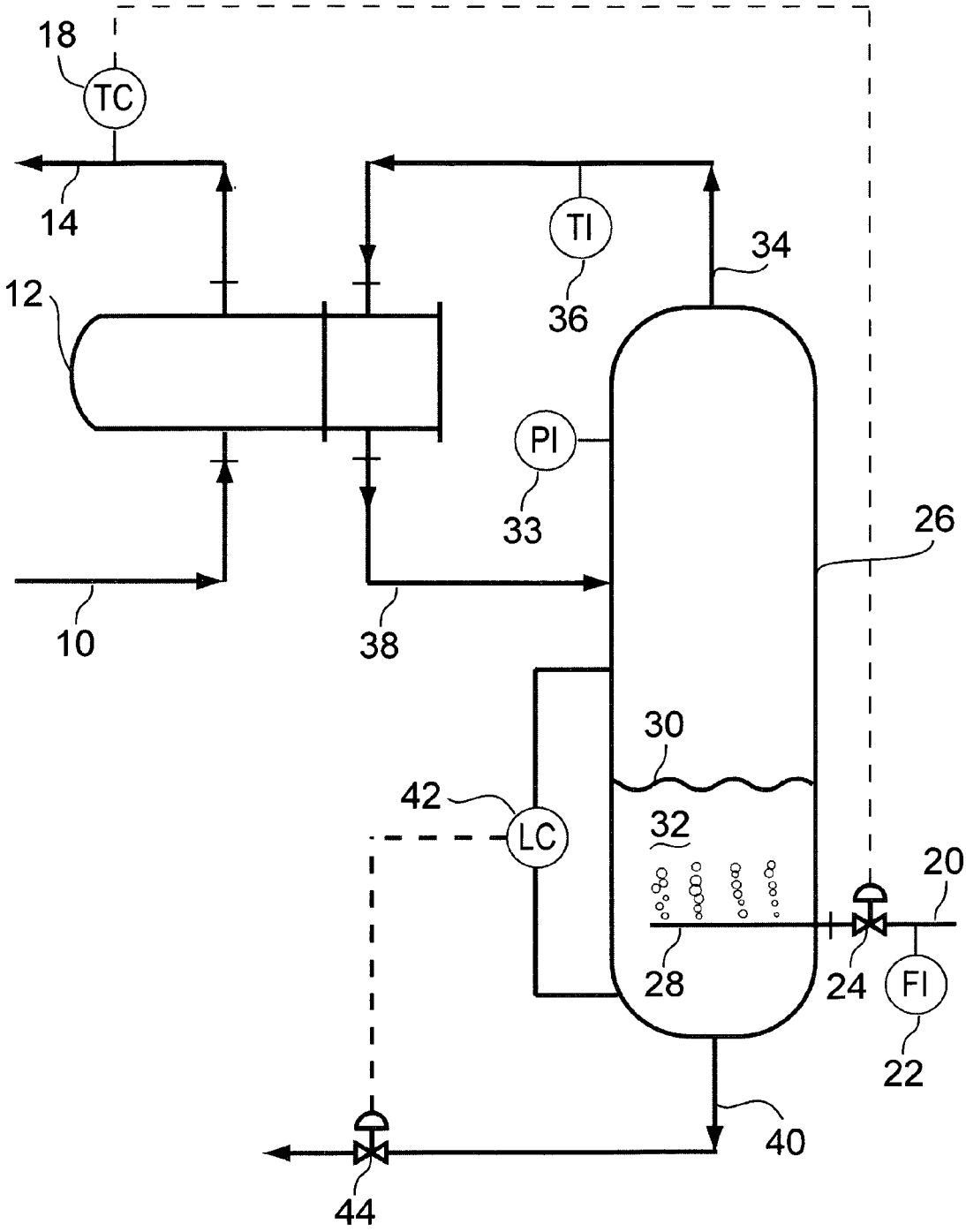
FIG. 1 is a schematic illustrating a typical installation of the passive desuperheater of this invention.

Heat exchangers using steam as the heat source are most efficient when the condition of the steam is saturated vapor, somewhat hotter than the target temperature of the fluid being heated. If the steam source is saturated, but too hot, process side "film boiling" can occur which impairs heat transfer efficiency. If the steam is not hot enough, excessive surface area is required due to the low driving force temperature difference across the exchanger.

In a steam heater, steam is introduced to one side of a shell and tube exchanger and process fluid is routed through the other side of the exchanger. For example: heavy naphtha from the bottom of a debutanizer communicates directly with the shell side of a shell and tube reboiler. Superheated 600 psig steam is routed to the tube side of the exchanger. As the steam condenses on the walls of the tubes, naphtha is heated and boiled on the shell side of the tubes. The condensed steam flows, by gravity, through the tubes and out the bottom of the exchanger into a condensate pot. The partially vaporized naphtha on the shell side is forced out the top of the shell side of the exchanger, back to the tower. The steam side condensate pot is normally drained on level control to maintain back pressure on the steam side of the exchanger.

The passive desuperheater utilizes the accumulating condensate to desuperheat incoming steam to saturated conditions by direct contact. Incoming steam is introduced below the liquid condensate level through a sparger to maximize direct contact heat transfer between the incoming steam and condensate. The incoming steam is cooled by the resident condensate as it bubbles through the liquid level. Steam leaving the condensate pot is at saturation point, somewhat warmer than the condensate drained from the exchanger.

The condensing temperature of steam is controlled by the pressure of the system. The pressure of the steam side with the passive desuperheater design is controlled by throttling incoming steam flow. Effectively, the condensing temperature on the steam side of the exchanger is varied to provide more or less driving force in the exchanger. As the driving force temperature difference changes, more or less heat transfer occurs to achieve the desired process outlet temperature.

The system is designed with the exchanger elevated above the condensate drum to allow condensate to free drain in to the drum. Steam is fed through a sparger into the bottom of the condensate drum, below the normal liquid level. Steam flow is modulated by a control valve, typically based on process outlet temperature. Condensate is drained from the drum via a control valve typically based on drum level. Additional system instrumentation would typically include flow indication on the incoming steam, level indication on the condensate drum, pressure indication on the condensate drum, and temperature indication on the steam line leaving the condensate drum.

A prior art system introduced steam above the liquid level in the bottom of the condensate drum and below a series of internal trays. Condensate from the exchanger was introduced above the internal trays. The trays were intended to promote mixing and heat transfer between the rising steam and the falling condensate. While this works, it does not work well. Direct contact desuperheating occurs but is insufficient due to inefficient contacting in the trays. Passive desuperheaters of this invention eliminate the contact trays inside by introducing superheated steam below the vessel liquid level via a sparger. Intimate contact between in the incoming steam and the condensate produce is ensured in this way. The new units with the revised design provide excellent results.

The present invention is illustrated by way of example in the accompanying drawings.

FIG. 1 is a schematic illustrating a typical installation of the passive desuperheater. FIG. 1 shows process stream 10 (naphtha) entering steam driven heater 12 on the shell side. Hot naphtha 14 exits the shell side of the steam heater and passes over the temperature sensor serving temperature controller 18. Superheated steam 20 enters the unit through optional flow indicator 22 and passes through temperature control valve 24. Temperature control valve 24 receives its control signal from temperature controller 18, modulating the in flow of superheated steam to control the final temperature of hot naphtha 14. Superheated steam from temperature control valve 24 enters passive desuperheater 26 via sparger 28 located below liquid level 30 of accumulated condensate 32 in passive desuperheater 26. Optional pressure indicator 33 allows monitoring desuperheater conditions. Steam exits sparger 28 and rises through condensate level 30 achieving intimate contact with condensate 32 and undergoing direct contact heat transfer to desuperheat the rising steam. Saturated steam 34 exits the top of vessel 26 and passes over optional temperature indicator 36 en route to the tube side of process heater 12. Saturated steam condenses in the tubes of the process heater yielding condensate 38 which flows by gravity back into passive desuperheater vessel 26. Spent condensate 40 is drawn from the bottom of passive desuperheater 26 based on maintaining constant level as measured by level instrument 42. The level reading from level instrument 42 is used to modulate the condensate level control valve 44 to maintain the system water balance.

Figure 2:
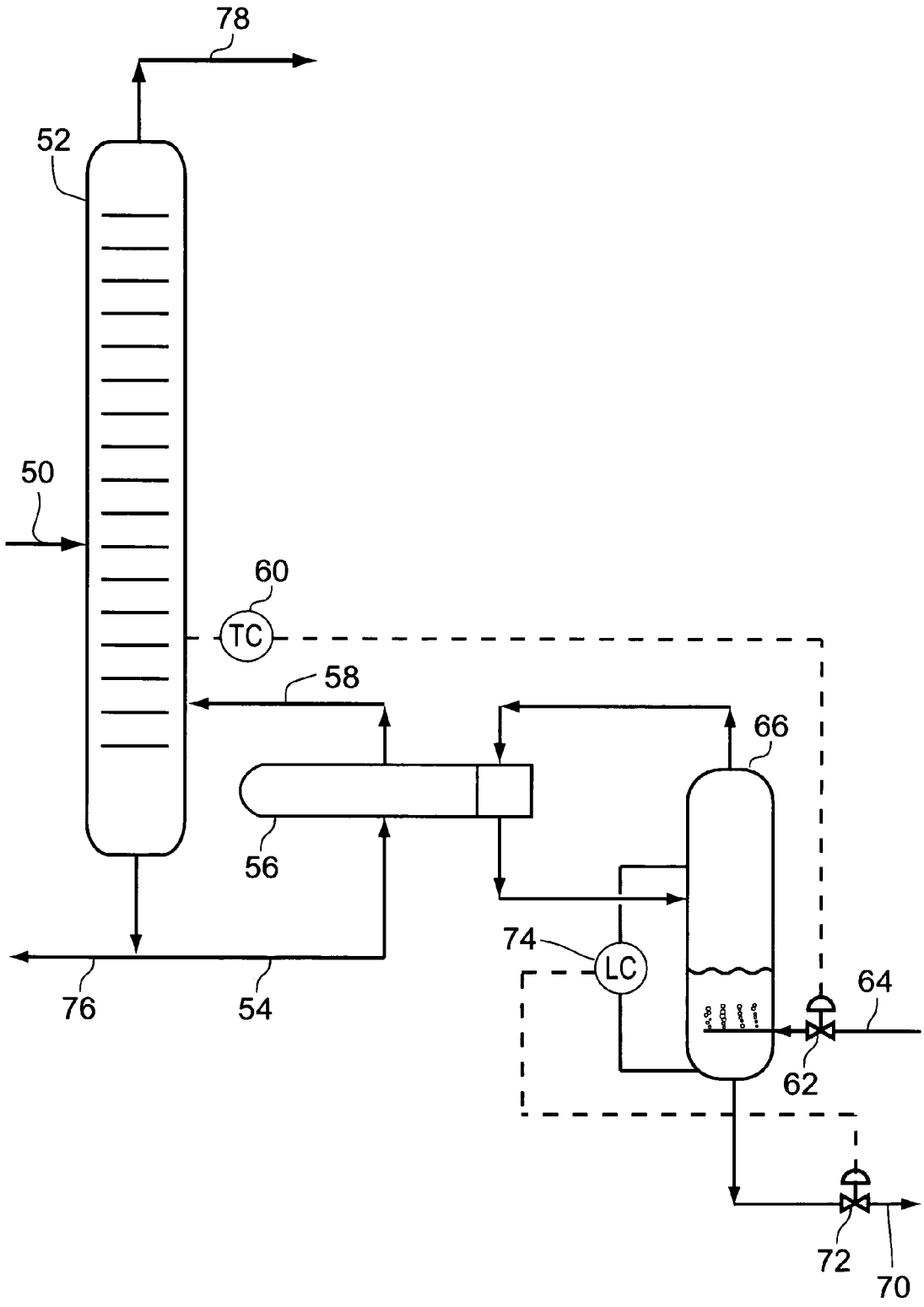
FIG. 2 is another schematic illustration of another typical service using the passive desuperheater of this invention.

FIG. 2 is a schematic illustrating another typical use for the passive desuperheater in service on a distillation tower reboiler. Process feed 50 (unstabilized naphtha) enters distillation tower 52. Accumulated tower bottoms is drawn from the bottom of tower 52 as stream 54 and routed to reboiler 56 where the naphtha stream is heated and at least partially vaporized before returning to the tower as stream 58. Temperature sensor 60 located a few trays up in the tower monitors tower conditions and sends a signal to temperature control valve 62 to control the flow of superheated steam 64 into passive desuperheater 66. The operation of desuperheater 66 is identical to the description for FIG. 1. Desuperheater 66 provides saturated steam to reboiler 56 and discharges condensate 70 via control valve 72 operated by level control 74. The distillation tower produces two process stream products, stabilized naphtha 76 from the bottom of the tower, and light overhead 78.

Figure 3:
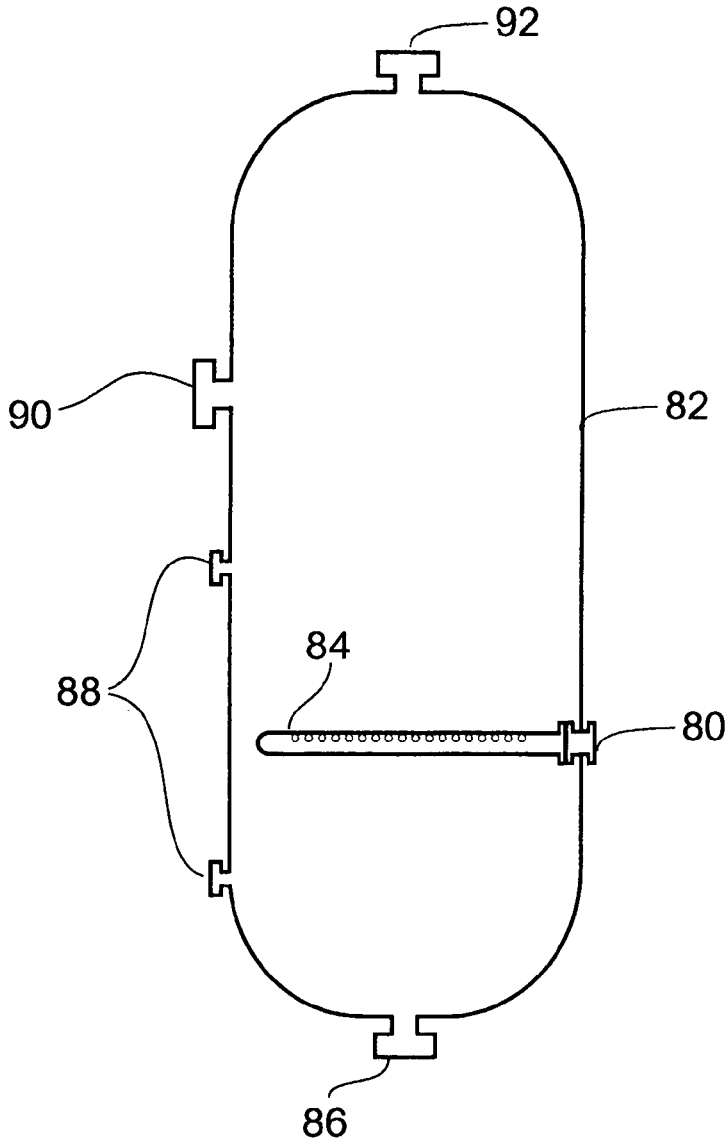
FIG. 3 is a schematic illustrating the passive desuperheater vessel and nozzle schedule.

FIG. 3 is a schematic illustrating the passive desuperheater vessel and nozzle schedule. Nozzle 80 is the superheated steam inlet to desuperheater 82. The steam is introduced through sparger 84. Nozzle 86 is the condensate liquid drain from the bottom of desuperheater 82. Nozzles 88 are level bridle connections for hooking up the level sensing instrument. Nozzle 90 is the condensate inlet nozzle for liquid returning from the associated exchanger. Nozzle 92 is the saturated steam outlet feeding desuperheated steam to the associated exchanger service.

Figure 4:
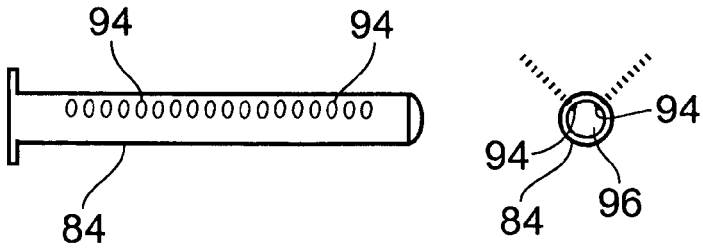
FIG. 4 illustrates the sparger of this invention in greater detail.

FIG. 4 illustrates sparger 84 in greater detail. Sparger 84 includes a multiplicity of apertures 94 which allow steam to perculate through condensate 32 of FIG. 1. This maximizes direct contact heat transfer between the incoming steam and condensate 32. Sparger 84 is a perforated hollow tube circumscribing space 96 through which steam passed to aperture 94.

Figure 5:
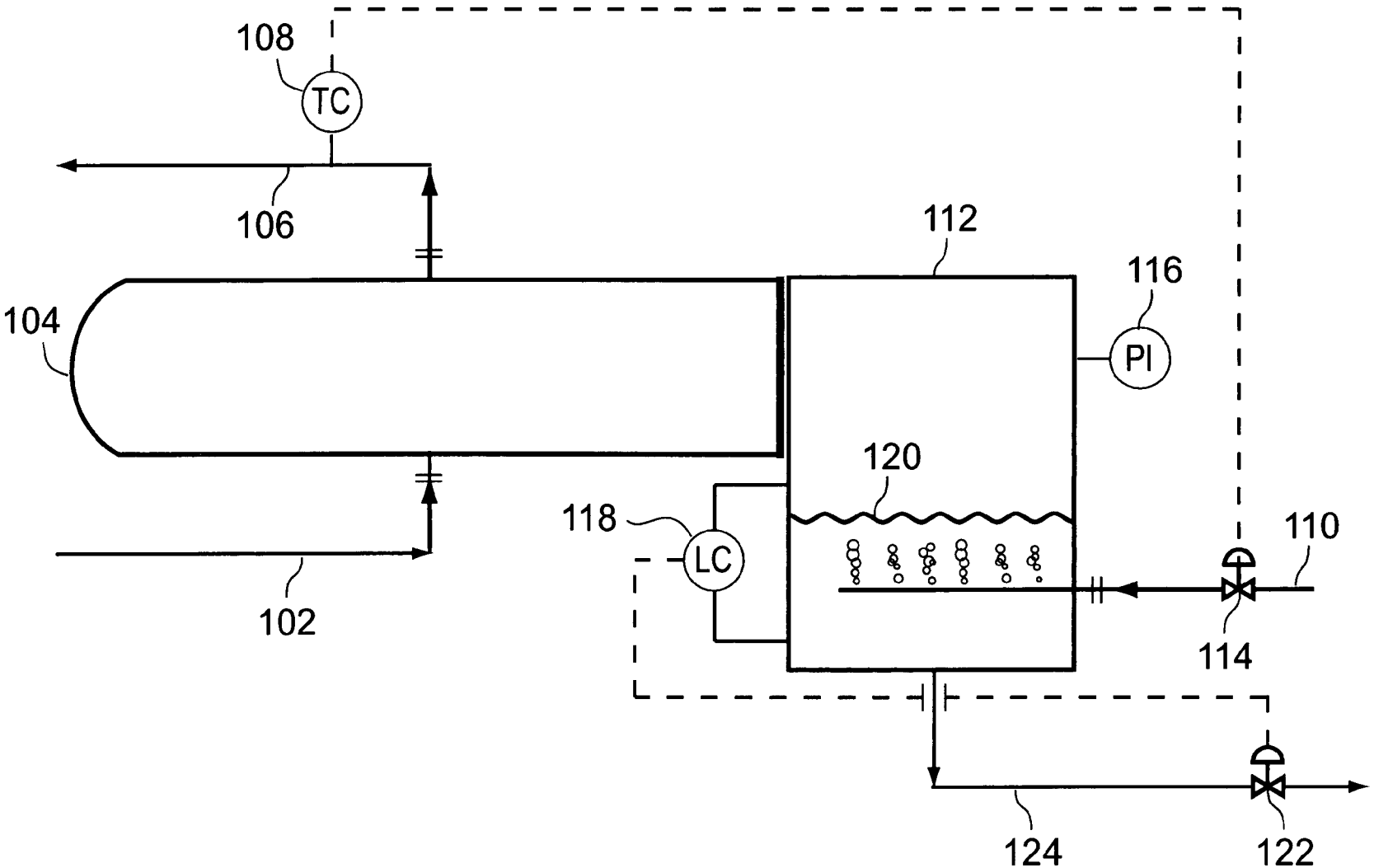
FIG. 5 illustrates a passive desuperheater incorporated within a heat exchanger.

FIG. 5 is a schematic showing an alternate configuration for the passive desuperheater where-in the passive desuperheater is incorporated into the exchanger itself. In this figure, cold process stream 102 enters the shell side of exchanger 104 where the stream is indirectly heated by steam condensing inside the exchanger tubes. The hot process stream 106 leaves the shell side of exchanger 104 and passes over temperature sensor 108 on its way to additional downstream processing. Superheated steam 110 enters tube side 112 of exchanger 104 via temperature control valve 114. Pressure of tube side 112 is monitored by pressure sensor 116. Level sensor 118 is used to adjust condensate level 120 in the tube side of the exchanger by manipulating condensate level control valve 122 ensuring adequate desuperheating is occurring. Spent condensate exits via line 124.

Figure 6:
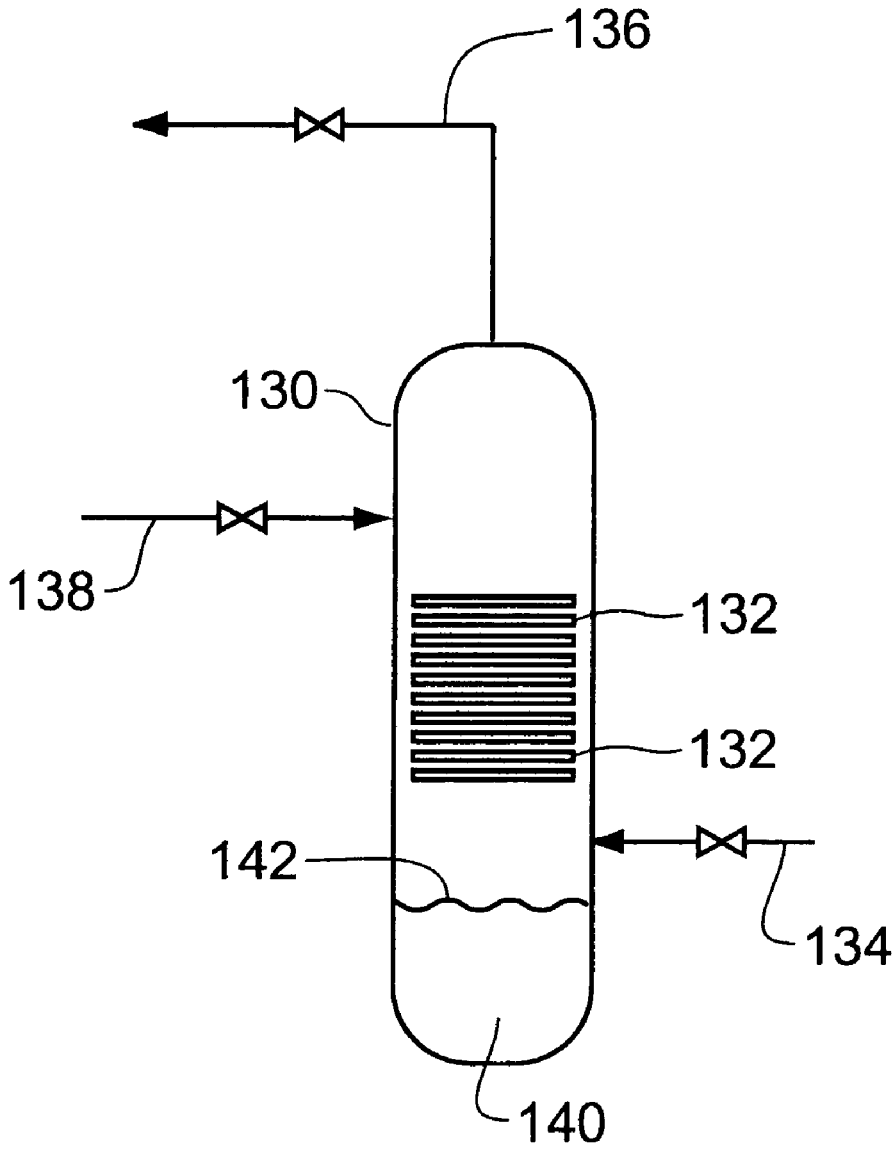
Prior Art Figure 6
FIG. 6 illustrates a prior art desuperheater.

FIG. 6 illustrates a prior art desuperheater. FIG. 6 shows prior art desuperheater 130. Desuperheater 130 includes traditional trays 132. Superheated steam enters desuperheater 130 via line 134 and passes upwardly through trays 132 and exits via line 136 as saturated steam. Condensate enters desuperheater 130 via line 138 and passes downwardly over trays 132. Condensate 140 accumulates in the bottom of desuperheater 130 below steam line 134. Condensate 140 has a liquid level 142 which also is below steam line 134.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. An apparatus for passively desuperheating a superheated gas stream to saturated conditions comprising:

a passive desuperheater for passively desuperheating a superheated gas stream to saturated conditions;

a means for accumulating condensate in the passive desuperheater wherein the condensate has a liquid level in the passive desuperheater;

an incoming stream of superheated gas entering the passive desuperheater below the liquid level of the condensate;

a pressure means for controlling the incoming stream of superheated gas entering the passive desuperheater;

an outgoing stream of desuperheated gas exiting the passive desuperheater above the liquid level of the condensate;

a heat exchanger that utilizes the outgoing stream of desuperheated gas exiting the passive desuperheater wherein the heat exchanger is elevated above the passive desuperheater;

a means for accumulating condensate in the heat exchanger; and a means for supplying the condensate from the heat exchanger to the passive desuperheater.

2. An apparatus according to claim 1 including a sparger in the incoming super heated gas stream to maximize direct contact heat transfer between the incoming stream and the condensate.

3. An apparatus according to claim 2 wherein the sparger is an internal sparger.

4. An apparatus according to claim 1 wherein the incoming superheated gas stream is superheated steam.

5. An apparatus according to claim 1 wherein the outgoing stream of desuperheated gas is saturated steam.

6. An apparatus according to claim 1 including a condensate pot as a separate vessel or integral with the heat exchanger for accumulating the condensate for the passive desuperheater.

7. A process for passively desuperheating a superheated gas stream to saturated conditions comprising the steps of:

providing a passive desuperheater for passively desuperheating a superheated gas stream to saturated conditions;

accumulating condensate in the passive desuperheater wherein the condensate has a liquid level in the passive desuperheater;

providing an incoming stream of superheated gas entering the passive desuperheater below the liquid level of the condensate;

using pressure to control the flow of superheated gas through the condensate;

withdrawing an outgoing stream of desuperheater gas exiting the passive desuperheated gas above the liquid level of the condensate;

utilizing the outgoing stream of desuperheated gas exiting the passive desuperheater in a heat exchanger wherein the heat exchanger is elevated above the passive desuperheater;

accumulating condensate in the heat exchanger; and supplying the condensate from the heat exchanger to the passive desuperheater.

8. A processing according to claim 7 including the step of passing the incoming superheated gas stream through a sparger to maximize direct contact heat transfer between the incoming stream and the condensate.

9. A process according to claim 8 wherein the sparger is an internal sparger.

10. An apparatus according to claim 7 wherein the incoming superheated gas stream is superheated steam.

11. An apparatus according to claim 7 wherein the outgoing stream of desuperheated gas is saturated steam.

12. A process according to claim 7 including the step of a condensate pot accumulating the condensate for the passive desuperheater in the heat exchanger.

13. A process according to claim 7 including the step of the superheated gas bubbling through the condensate to form the outgoing stream of desuperheated gas.

14. A process according to claim 7 including the step of cooling the superheated gas by passing it through the condensate to form the outgoing stream of desuperheated gas.

15. A process according to claim 7 including the step of using desuperheater temperature to control the flow of superheated gas through the condensate.

16. A process according to claim 7 including the step of using process temperature to control the flow of superheated gas through the condensate.

* * * * *